US010016651B2

(12) United States Patent
Lee

(10) Patent No.: US 10,016,651 B2
(45) Date of Patent: Jul. 10, 2018

(54) MULTIFUNCTIONAL ARM CRANKING EXERCISER

(71) Applicant: Jin-Cheng Lin, Kaohsiung (TW)

(72) Inventor: Zong-Hua Lee, New Taipei (TW)

(73) Assignee: VIVASPORTS CO., LTD., Seoul (KR)

( * ) Notice: Subject to any disclaimer, the term of this patent is extended or adjusted under 35 U.S.C. 154(b) by 0 days.

(21) Appl. No.: 15/364,083

(22) Filed: Nov. 29, 2016

(65) Prior Publication Data

US 2017/0291061 A1 Oct. 12, 2017

(30) Foreign Application Priority Data

Apr. 12, 2016 (TW) ..... 105205046 U

(51) Int. Cl.

| | |
|---|---|
| ***A63B 22/00*** | (2006.01) |
| ***A63B 21/00*** | (2006.01) |
| ***A63B 21/22*** | (2006.01) |
| ***A63B 23/035*** | (2006.01) |
| ***A63B 71/06*** | (2006.01) |
| ***A63B 21/015*** | (2006.01) |
| *A63B 22/06* | (2006.01) |

(52) U.S. Cl.

CPC .... *A63B 22/0012* (2013.01); *A63B 21/00069* (2013.01); *A63B 21/015* (2013.01); *A63B 21/225* (2013.01); *A63B 22/0002* (2013.01); *A63B 22/0005* (2015.10); *A63B 22/0046* (2013.01); *A63B 23/03533* (2013.01); *A63B 71/0619* (2013.01); *A63B 22/0605* (2013.01); *A63B 2022/0611* (2013.01); *A63B 2022/0617* (2013.01); *A63B 2220/30* (2013.01)

(58) Field of Classification Search

CPC ..... A63B 22/0012; A63B 22/0005; A63B 21/00069; A63B 21/015; A63B 21/225; A63B 22/0002; A63B 22/0046; A63B 23/03533; A63B 71/0619; A63B 22/0625; A63B 2022/0611; A63B 2022/0617; A63B 2220/30

See application file for complete search history.

(56) References Cited

U.S. PATENT DOCUMENTS 1,820,372 A * 8/1931 Blomquist ..... A63B 22/001 482/62

3,731,921 A * 5/1973 Andrews, Jr. ..... A63B 21/154 482/115

(Continued)

*Primary Examiner* — Andrew S Lo

(74) *Attorney, Agent, or Firm* — Andrew C. Cheng

(57) ABSTRACT

A multifunctional arm cranking exerciser includes an omni-directional support bracket assembly, which comprises a five-way bracket mounted to a top thereof and having a left side to which a left arm exercising device is mounted and a right side to which a right arm exercising device is mounted. Also mounted on the five-way bracket are a damping adjustment device and a quick release pin device. The quick release pin device allows for quick coupling and positioning of left and right arm cranks of the left and right arm exercising devices at an angular difference of 0 degree or 180 degrees and also allows for quick release and decoupling of the left and right arm exercising devices to be independent of each other. The damping adjustment device adjusts and regulates a level of damping for achieving an effect of efficient exercising.

17 Claims, 10 Drawing Sheets

(56) References Cited

U.S. PATENT DOCUMENTS 3,770,268 A * 11/1973 Castello ..... A63B 5/22 482/81
4,582,318 A * 4/1986 Giannelli ..... A63B 21/154 280/261
4,915,374 A * 4/1990 Watkins ..... A63B 22/0605 482/57
5,232,422 A * 8/1993 Bishop, Jr. ..... A63B 22/0007 482/57
5,330,402 A * 7/1994 Johnson ..... A63B 22/0012 482/52
5,980,431 A * 11/1999 Miller, Jr. ..... A63B 22/0007 482/57
5,989,162 A * 11/1999 Daniels ..... A63B 22/0012 482/62
7,530,932 B2 * 5/2009 Lofgren ..... A63B 22/0002 482/62
7,789,808 B2 * 9/2010 Lee ..... A63B 22/0007 482/57
7,918,768 B2 * 4/2011 Rogozinski ..... A63B 22/0015 482/51
9,199,114 B1 * 12/2015 Santoro ..... A63B 21/015
9,566,469 B1 * 2/2017 Rector ..... A63B 23/0476
9,636,539 B1 * 5/2017 Brumit ..... A63B 22/0002
9,643,041 B2 * 5/2017 Neill ..... A63B 21/0088
2003/0092536 A1 * 5/2003 Romanelli ..... A61H 1/0214 482/60
2011/0275486 A1 * 11/2011 Hsu ..... A63B 21/157 482/57
2011/0300997 A1 * 12/2011 Ilett ..... A63B 22/0007 482/80
2012/0238406 A1 * 9/2012 Beard ..... A63B 21/0053 482/2
2014/0113776 A1 * 4/2014 Jaguan ..... A63B 71/023 482/57

* cited by examiner

MULTIFUNCTIONAL ARM CRANKING EXERCISER

BACKGROUND OF THE INVENTION

1. Field of the Invention

The present invention relates to the field of exercisers, and more particularly to one that provides, technically, a multifunctional arm cranking exerciser that provides exercising modes of collaborative operation, synchronous operation, or independent operation of two arm exercising devices and also comprises a damping adjustment device for adjusting and regulating damping and a universal support bracket assembly for attachment to a fixture or an existing or any other leg exerciser.

2. The Related Arts

Taiwan Patent Application No. 100213484 discloses a multifunctional transmission device for indoor/outdoor bicycle, which provides multiple functions, but with an extremely complicated mechanism. Such a complicated mechanism makes maintenance operations difficult and may easily get broken. Further, conventional arm exercisers are structured for being gripped or held with two hands for rotation, but such exercisers can be operated with two cranks being constantly separated by 180 degrees, this making exercise boring and not interesting at all. Further, the conventional arm exercisers are generally stand-alone devices and they do not allow for attachment to other exercising devices. In view of these, further improvements are necessary for the conventional arm exercisers.

In consideration of the drawbacks of the prior art discussed above, it is a challenge of those involved in this field to provide a novel structure that helps overcome or alleviates the above problems.

SUMMARY OF THE INVENTION

The primary objective of the present invention is to provide a multifunctional arm cranking exerciser, which provides various exercising modes of collaborative operation, synchronous operation, or independent operation of two arm exercising devices and also comprises a damping adjustment device for adjusting and regulating damping and a universal support bracket assembly for attachment to a fixture or an existing or any other leg exerciser.

To achieve the above objective, the present invention provides a multifunctional arm cranking exerciser, which comprises: an omnidirectional support bracket assembly, which comprises a five-way bracket mounted to a top thereof and having a left side to which a left arm exercising device is mounted and a right side to which a right arm exercising device is mounted. Also mounted on the five-way bracket are a damping adjustment device and a quick release pin device. The quick release pin device allows for quick coupling and positioning of left and right arm cranks of the left and right arm exercising devices at an angular difference of 0 degree or 180 degrees and also allows for quick release and decoupling of the left and right arm exercising devices to be independent of each other. The damping adjustment device adjusts and regulates a level of damping for achieving an effect of efficient exercising. The omnidirectional support bracket assembly allows the multifunctional arm cranking exerciser to be attached to an existing or separately purchased leg exerciser to form a hand and leg exerciser.

BRIEF DESCRIPTION OF THE DRAWINGS

The present invention can be fully understood from the following detailed description and preferred embodiments with reference to the accompanying drawings, in which.

DETAILED DESCRIPTION OF THE PREFERRED EMBODIMENTS

Figure 1:
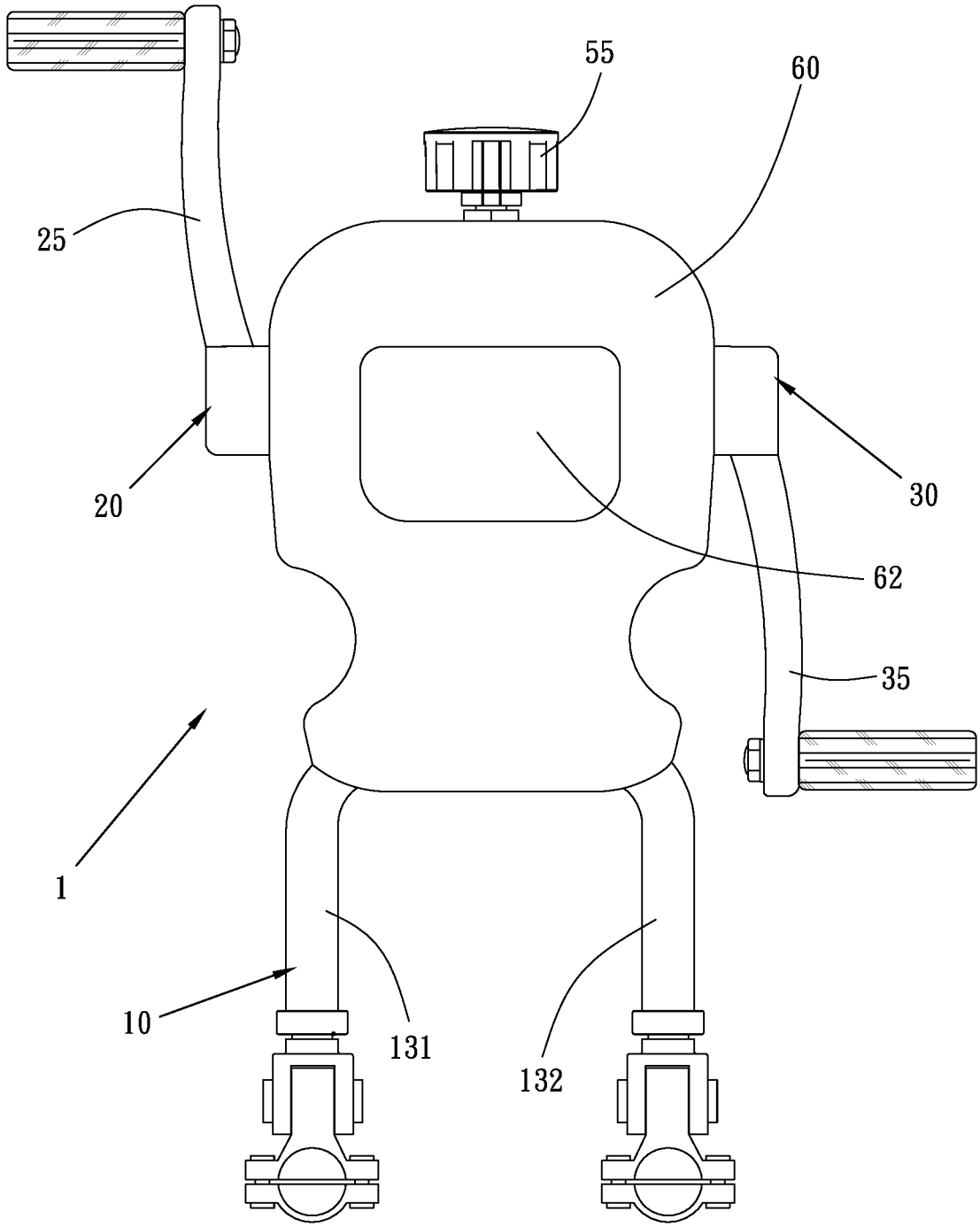
FIG. 1 is a front view showing the present invention with a housing attached thereto.
Figure 2:
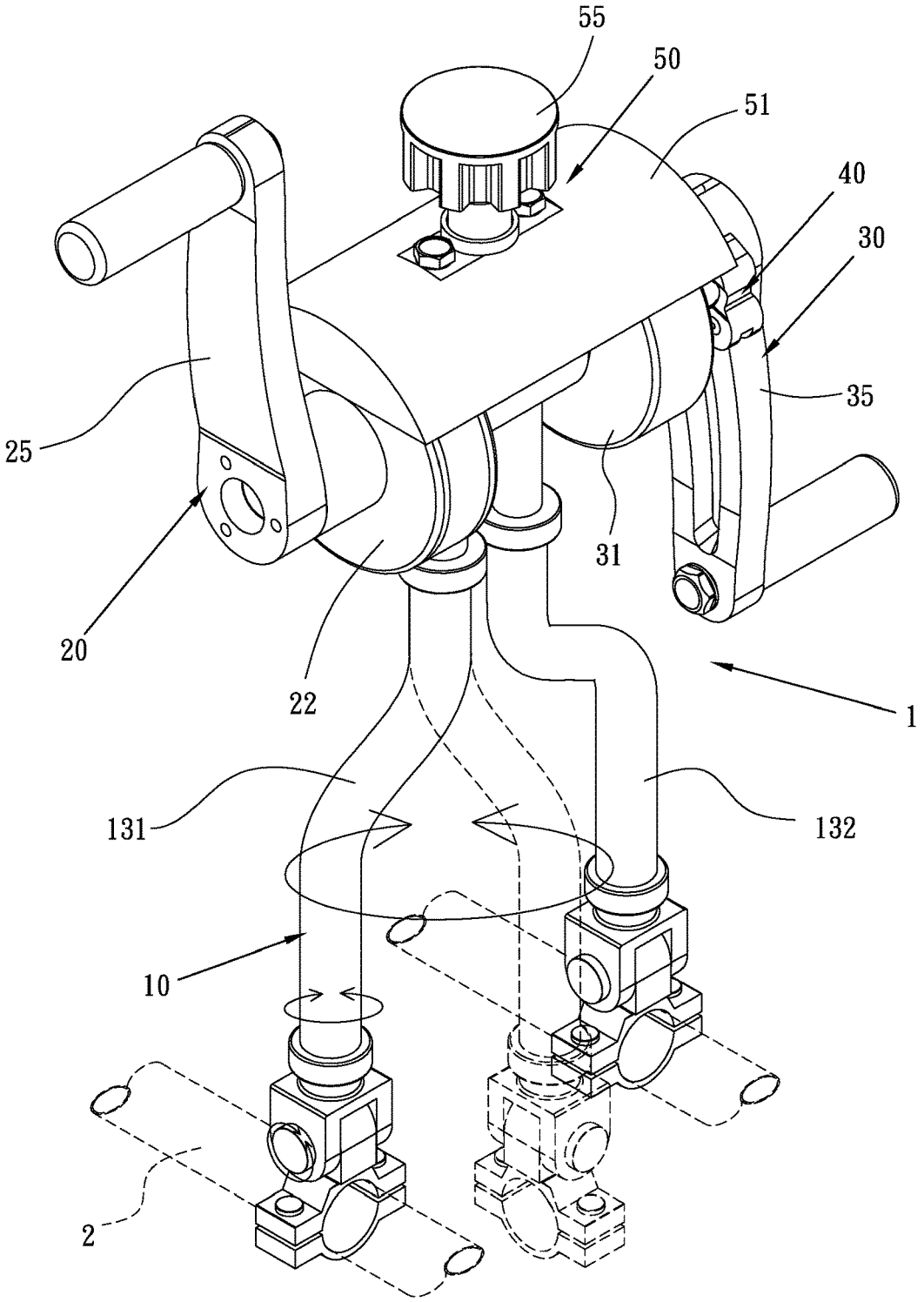
FIG. 2 is a perspective view, taken from a left side, illustrating an embodiment of the present invention.
Figure 3:
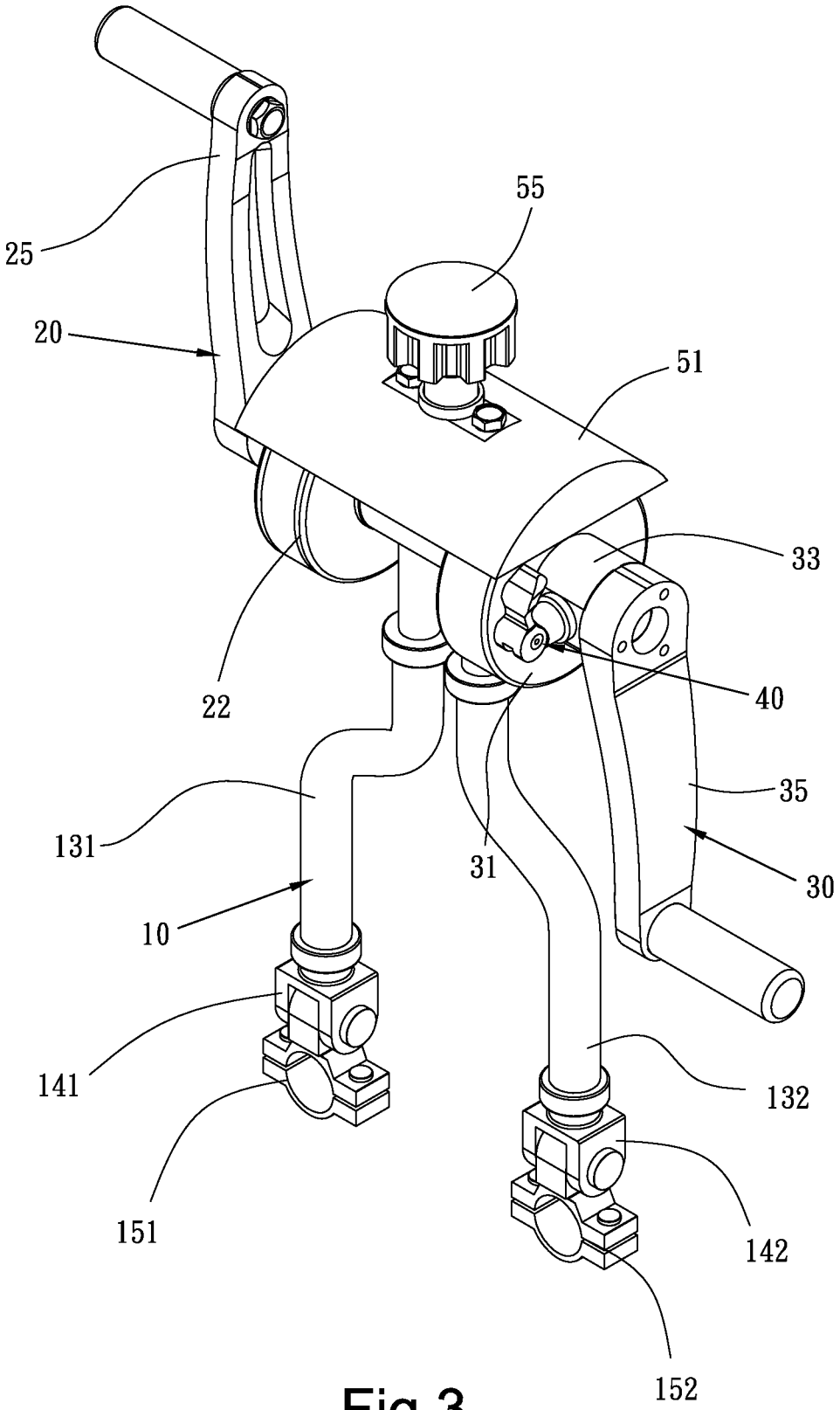
FIG. 3 is a perspective view, taken from a right side, illustrating an embodiment of the present invention.
Figure 4:
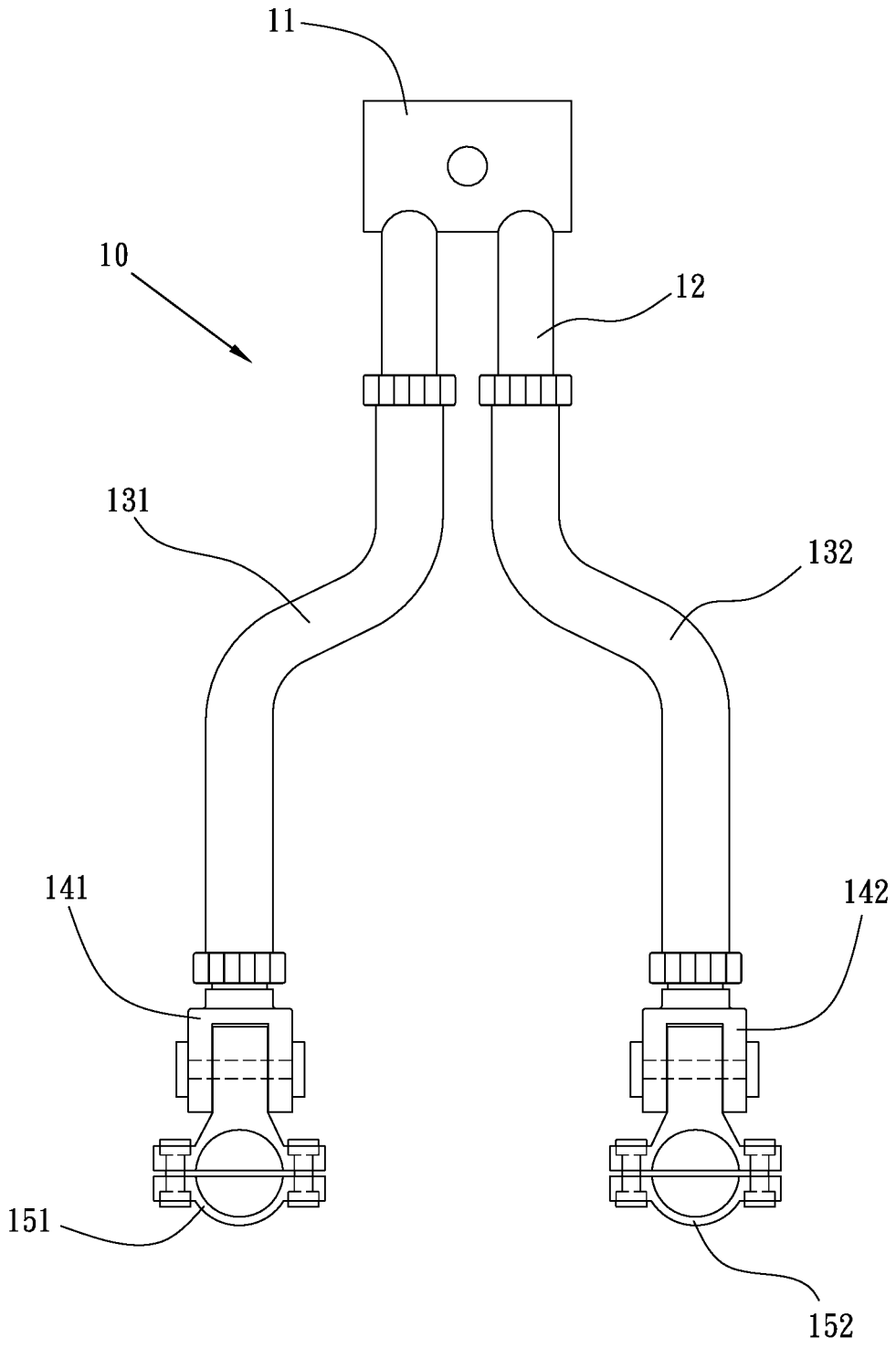
FIG. 4 is a front view illustrating an omnidirectional support bracket according to an embodiment of the present invention.

To better expound the purposes, features, and effectiveness of the present invention to help better understand and appreciate the present invention, description will be given below with reference to embodiments and drawings of the present invention.

The present invention provides a multifunctional arm cranking exerciser.

To provide a better understanding of the purpose, features, and effectiveness of the present invention, a detailed description will be provided with reference to preferred embodiments and the accompanying drawings.

Referring to FIGS. 1-10, the present invention provides a multifunctional arm cranking exerciser, which comprises:

an omnidirectional support bracket assembly 10, wherein the omnidirectional support bracket assembly 10 comprises a top end to which a five-way bracket 11 is fixedly mounted and the omnidirectional support bracket assembly 10 allows the multifunctional arm cranking exerciser 1 to be attached to a bar 2 of an existing or a separately purchased leg exerciser to form a hand and leg exerciser;

a left arm exercising device 20, wherein the left arm exercising device 20 is mounted to a left side of the five-way bracket 11;

a right arm exercising device 30, wherein the right arm exercising device 30 is mounted to a right side of the five-way bracket 11;

a quick release pin device 40, wherein the quick release pin device 40 allows for quick coupling and positioning of left and right arm cranks 25, 35 of the left and right arm exercising devices 20, 30 at an angular difference of 0 degrees for synchronous movement (or operation) thereof or at an angular difference of 180 degrees for linked, collaborative movement (or operation) and also allows for quick release and decoupling of the left and right arm exercising devices 20, 30 for independent operation; and a damping adjustment device 50, wherein the damping adjustment device 50 is mounted on the five-way bracket 11 and the damping adjustment device 50 generates and applies damping or a resisting force to the left arm exercising device 20 and the right arm exercising device 30, and the damping adjustment device 50 is operable for adjustment to a desired level of the damping or the resisting force in order to achieve an effect of efficient exercising.

In the multifunctional arm cranking exerciser, the left arm exercising device 20 comprises a central axle 21 rotatably mounted in the five-way bracket 11. The central axle 21 has a left portion that comprises, formed and arranged thereon, a male spline 211 and a left flywheel 22, wherein the left flywheel 22 comprises a first female spine 221 extending therein or therethrough to allow the left flywheel 22 to be mounted, via the first female spine 221, to the male spline 211 of the central axle 21; a first fixation block 23, wherein the first fixation block 23 comprises a second female spine 231 extending therein or therethrough to allow the first fixation block 23 to be mounted, via the second female spine 231, to the male spline 211 of the central axle 21 and wherein the left portion of the central axle 21 is provided with a first external thread 212 to receive a first nut 24 to screw thereto for fixation to the first fixation block 23 and the left flywheel 22, and the first fixation block 23 is provided, in an end surface thereof, with a plurality of threaded holes 232; and a left arm crank 25, wherein the left arm crank 25 receives a plurality of screws 251 extending therethrough to screw to the plurality of threaded holes 232 formed in the end surface of the first fixation block 23 to fix, as a combined unitary structure, the central axle 21, the left flywheel 22, the first fixation block 23, and the left arm crank 25 together to form the left arm exercising device 20.

In the multifunctional arm cranking exerciser, the right arm exercising device 30 comprises a right flywheel 31 that is fit and mounted, in a spaced manner, via a plurality of bearings 32, to the central axle 21 and a second fixation block 33 that is also fit and mounted, in a spaced manner, via a plurality of bearings 32, to the central axle 21, wherein the right flywheel 31 has an end surface in which a first keyway 311 is formed, and the second fixation block 33 has an end surface in which a second keyway 331 is formed and corresponding thereto and a key 34 is received in the first and second keyways 311, 331 so as to couple the right flywheel 31 and the second fixation block 33 to each other, the central axle 21 having a right portion that is provided with a second external thread 213 to receive a second nut 26 to screw thereto for positioning and constraining the second fixation block 33, the second fixation block 33 having an opposite end surface in which a plurality of threaded holes 332 is formed; and a right arm crank 35, wherein the right arm crank 35 receives a plurality of screws 351 extending therethrough to screw to the plurality of threaded holes 332 formed in the end surface of the second fixation block 33 to couple and combine the right arm crank 35, the second fixation block 33, and the right flywheel 31 together to form the right arm exercising device 30.

Figure 5:
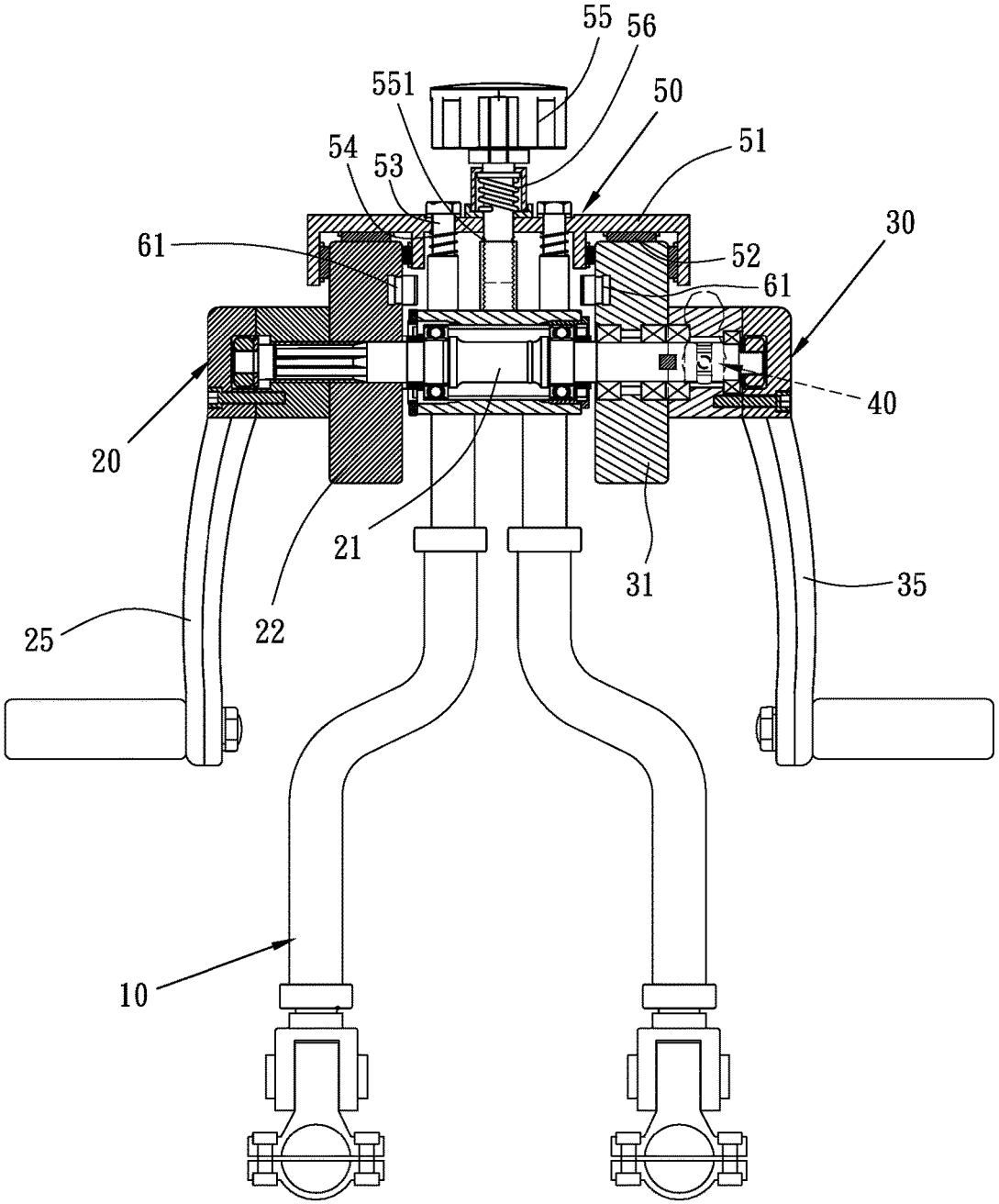
FIG. 5 is a cross-sectional view illustrating an embodiment of the present invention in an example of operation.
Figure 6:
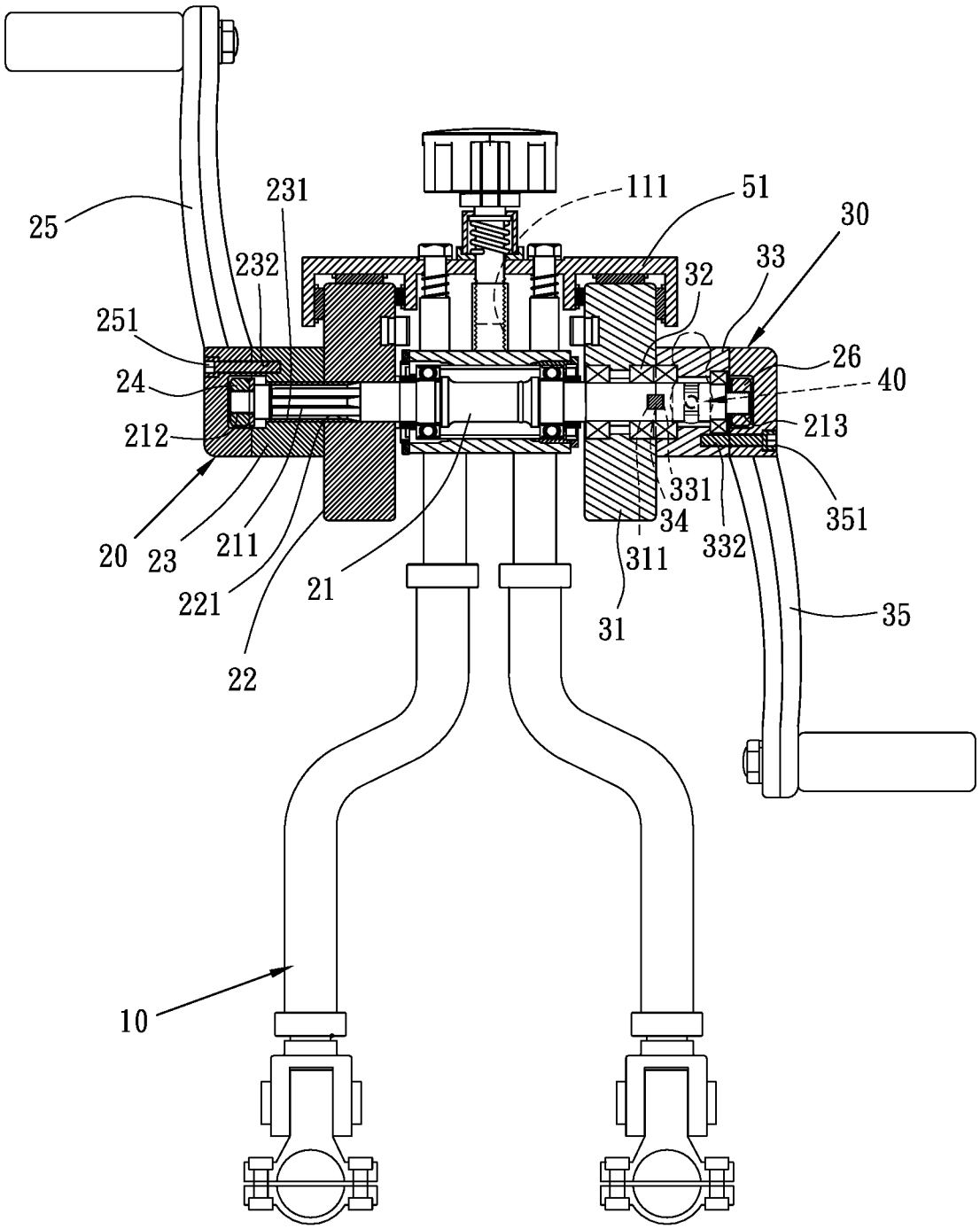
FIG. 6 is a cross-sectional view illustrating an embodiment of the present invention in another example of operation.
Figure 7:
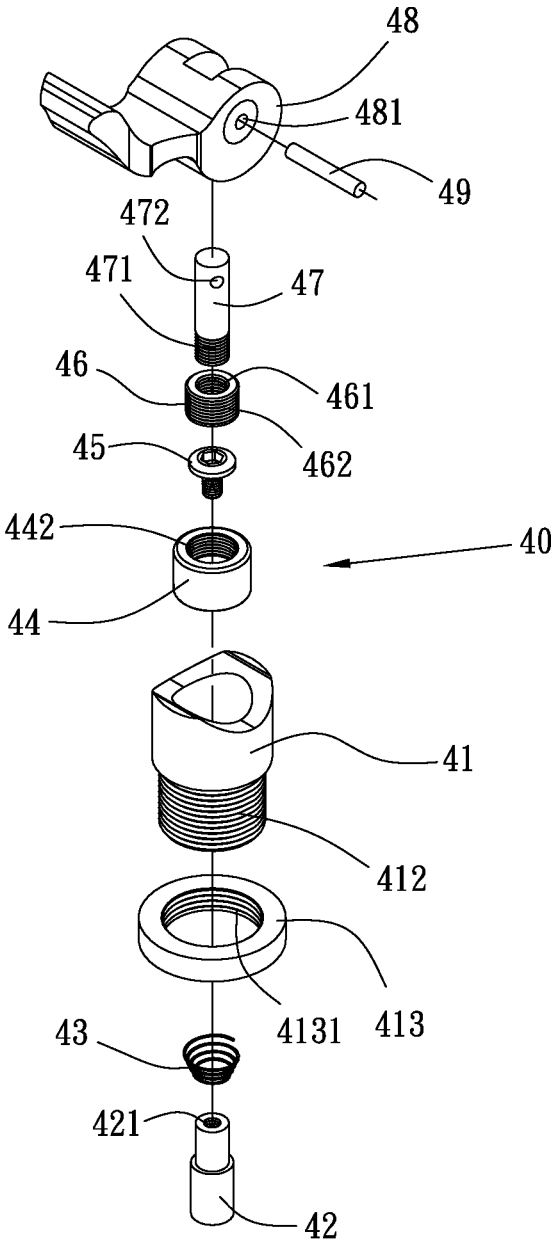
FIG. 7 is an exploded view illustrating a quick release pin device according to an embodiment of the present invention.
Figure 8:
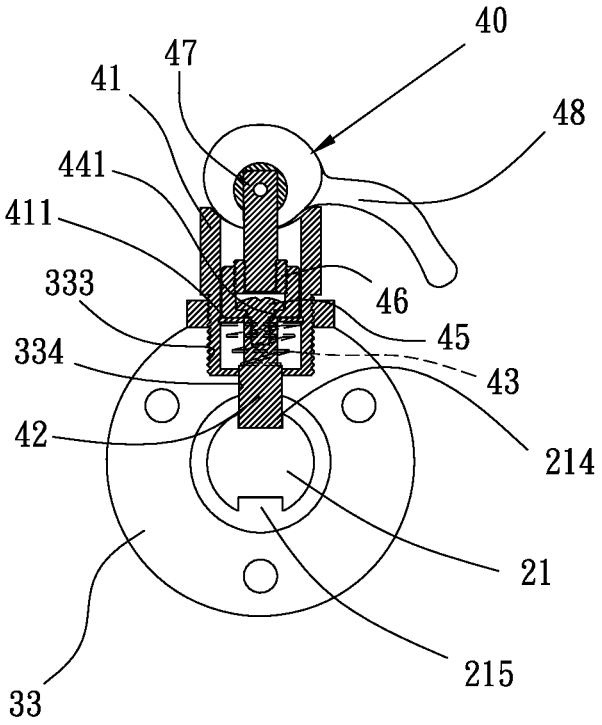
FIG. 8 is a cross-sectional view illustrating the quick release pin device set in engagement with a 0-degree position of a central axle according to an embodiment of the present invention.
Figure 9:
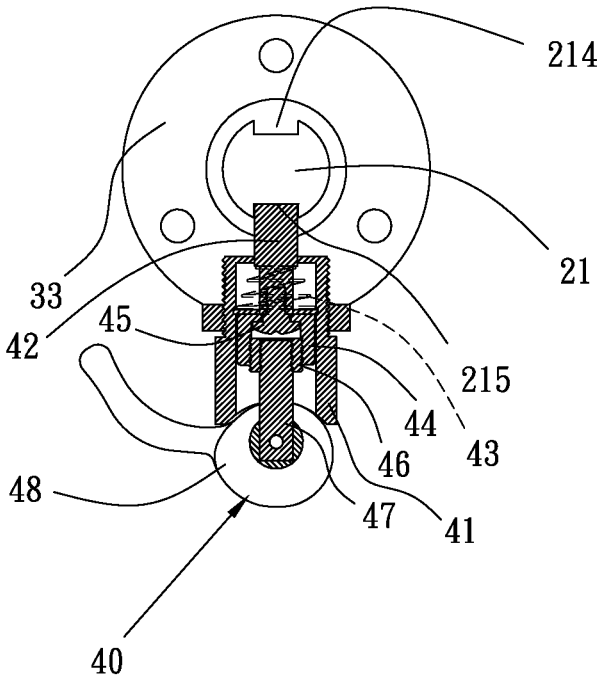
FIG. 9 is a cross-sectional view illustrating the quick release pin device set in engagement with a 180-degree position of a central axle according to an embodiment of the present invention.
Figure 10:
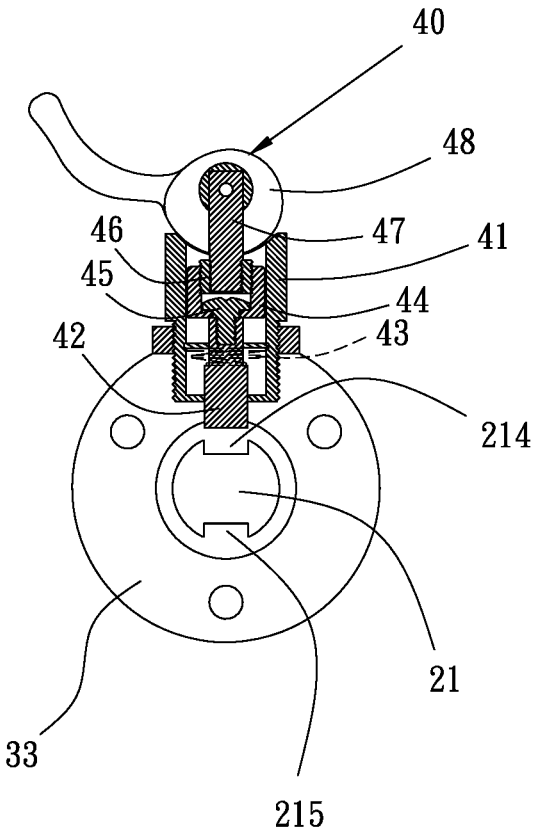
FIG. 10 is a cross-sectional view illustrating the quick release pin device set in disengagement with and thus separated from a central axle according to an embodiment of the present invention.

In the multifunctional arm cranking exerciser, the quick release pin device 40 comprises a quick release tubular seat 41, wherein the quick release tubular seat 41 comprises, arranged therein, a stop plate 411; a pin 42 that receives a spring 43 fit thereto and is set to extend through the stop plate 411 such that an end of the spring 43 abuts the pin 42 and an opposite end abuts the stop plate 411; an outer sleeve 44 that comprises a through hole 441 and an internal thread 442 formed therein, wherein the through hole 441 receives a front end of a fixing threaded fastener 45 to extend therethrough to screw to an internal thread 421 of the pin 42; an inner sleeve 46 that is provided with internal and external threads 461, 462, wherein the external thread 462 is screwed to the internal thread 442 of the outer sleeve 44 and the internal thread 461 receives an external thread 471 of a connection rod 47 to screw thereto and the connection rod 47 comprises a pin hole 472 formed therein at a location close to a top end; an eccentric rotary knob 48 that comprises a pin hole 481 formed therein and aligning with the pin hole 472 of the connection rod 47 to receive a pivot pin 49 therethrough, wherein the eccentric rotary knob 48 abuts against a top curved surface of the quick release tubular seat 41 and the quick release tubular seat 41 is provided with an external thread 412 on a lower end thereof; a ring 413, which together with the second fixation block 33, is provided with an internally threaded hole 4131, 333 to screw to the external thread 412 of the quick release tubular seat 41, wherein the second fixation block 33 is provided with an aperture 334 inwardly of the internally threaded hole 333; the aperture 334 receives the pin 42 to extend therethrough; the central axle 21 is set at a location in alignment with the pin 42 and is provided with a 0-degree insertion hole 214 and a 180-degree insertion hole 215 at locations respectively corresponding to the left arm crank 25 being set at the same angular position or at an angular position with an angular offset of 180 degrees; the eccentric rotary knob 48 is manually operable for releasing a holding or pulling force and the spring 43 biases and pushes the pin 42 into and thus being retained in for example the 0-degree insertion hole 214 to allow the left and right arm exercising devices 20, 30 to move synchronously (as shown in FIGS. 5, 7, and 8), or alternatively, the spring 43 biases and pushes the pin 42 into and thus being retained in the 180-degree insertion hole 215 to allow the left and right arm exercising devices 20, 30 to collaboratively move, similar to that between two pedals of a bicycle (as shown in FIGS. 6, 7, and 9); and the eccentric rotary knob 48 is alternatively operable, through rotation thereof, to induce a pulling force, in an upward direction, for lifting the pin 42 and compressing the spring 43 so as to allow the left and right arm exercising devices 20, 30 to move independently, allowing for exercise with a single hand or independent exercises for two hands (as shown in FIGS. 7 and 10).

In the multifunctional arm cranking exerciser, the damping adjustment device 50 comprises a curved plate 51, wherein the curved plate 51 is provided, on two opposite sides, which respectively face the left and right flywheels 22, 31, and a circumferential surface thereof, with a plurality of brake plates 52 and the curved plate 51 is provided, on two opposite sides of a middle thereof, with guide bars 53, wherein the guide bars 53 support upward the curved plate 51 with elastic members 54 arranged on inner side of the curved plate 51; a rotary pressure knob 55, wherein the rotary pressure knob 55 is set, via an elastic element 56, on the curved plate 51 in an abutting engagement therewith and the rotary pressure knob 55 is screwed, through an external thread 551, to an internal thread 111 formed on the top of the five-way bracket 11 so that rotating and tightening the rotary pressure knob 55 makes the elastic element 56 applies a great pressing force to the curved plate 51 whereby the brake plates 52 may induce a great damping or resisting force to the left and right flywheels 22, 31.

In the multifunctional arm cranking exerciser, the omnidirectional support bracket assembly 10 comprises two tubular bodies 12 extending downward from the five-way bracket 11 and the two tubular bodies 12 are respectively provided, on lower ends thereof, with a first curved tube 131 and a second curved tube 132 rotatably mounted thereto such that the first and second curved tubes 131, 132 are rotatable, for 360 degrees, to optimum positions, wherein the first curved tube 131 comprises a first swivel terminal 141 rotatably mounted to a lower end thereof and the first swivel terminal 141 comprises a first swing member 151 rotatably mounted to a lower end thereof so that the first swivel terminal 141 is allowed for rotation through a range of 360 degrees for an optimum angular position, while the first swing member 151 is allowed to swing or rotate in a front-rear direction for a range of 340 degrees; and the second curved tube 132 comprises a second swivel terminal 142 rotatably mounted to a lower end thereof and the second swivel terminal 142 comprises a second swing member 152 rotatably mounted to a lower end thereof, so that the second swivel terminal 142 is allowed for rotation through a range of 360 degrees for an optimum angular position, while the second swing member 152 is allowed to swing or rotate in a front-rear direction for a range of 340 degrees. The first and second swing members 152 are attachable to a bar 2 of a separately purchased or existing leg exerciser.

Referring to FIGS. 1, 5, and 6, the multifunctional arm cranking exerciser 1 further comprises an enclosure 60, wherein the enclosure 60 is mounted to an outer circumference of the multifunctional arm cranking exerciser 1; the five-way bracket 11 and the left flywheel 22 and the right flywheel 31 are provided with a plurality of sensor elements 61 corresponding to each other; and the enclosure 60 is provided with a display screen 62 electrically connected to the sensor elements 61 so that rotational speed of the left or right flywheel 22, 31 can be displayed on the display screen 62 to be viewed by a user.

In summary, the present invention provides a multifunctional arm cranking exerciser, which is an innovated design featuring novel structural arrangement that has not been disclosed or proposed before and provides multiple exercise modes of collaborative operation, synchronous operation, and independent operation for two arm exercising devices and also includes a damping adjustment device for regulating and adjusting damping or resisting force thereof and an omnidirectional support bracket for attachment to a fixture or an existing or any other leg exerciser.

Illustrated above are the embodiments of the present disclosure, which should not be considered limitative to the scope of the invention. Therefore, any equivalent substitutions or variations to the structures or processes disclosed in the specification and the drawing of the present disclosure, or a direct or indirect application of the invention to the other technical fields should be considered as part of the present disclosure.

What is claimed is:

1. A multifunctional arm cranking exerciser, comprising:

an omnidirectional support bracket assembly, which comprises a top end to which a five-way bracket is fixedly mounted, the omnidirectional support bracket assembly being adapt to allow the multifunctional arm cranking exerciser to be attached to an existing or a separate leg exerciser to form a hand and leg exerciser;

a left arm exercising device, which is mounted to a left side of the five-way bracket;

a right arm exercising device, which is mounted to a right side of the five-way bracket;

a quick release pin device, which is operable for selectively quick coupling and positioning of left and right arm cranks of the left and right arm exercising devices at an angular difference of 0 degrees for synchronous movement or at an angular difference of 180 degrees for linked, collaborative movement or for selectively quick release and decoupling of the left and right arm exercising devices for independent operation; and a damping adjustment device, which is mounted on the five-way bracket and generates and applies damping or a resisting force to the left arm exercising device and the right arm exercising device, and is operable for adjustment of the damping or the resisting force in order to achieve an effect of exercising;

wherein the left arm exercising device comprises a central axle rotatably mounted in the five-way bracket and the central axle has a left portion that comprises, formed and arranged thereon, a male spline and a left flywheel, wherein the left flywheel comprises a first female spine extending therein or therethrough to allow the left flywheel to be mounted, via the first female spine, to the male spline of the central axle; a first fixation block, wherein the first fixation block comprises a second female spine extending therein or therethrough to allow the first fixation block to be mounted, via the second female spine, to the male spline of the central axle and wherein the left portion of the central axle is provided with a first external thread to receive a first nut to screw thereto for fixation to the first fixation block and the left flywheel, and the first fixation block is provided, in an end surface thereof, with a plurality of threaded holes; and a left arm crank, wherein the left arm crank receives a plurality of screws extending therethrough to screw to the plurality of threaded holes formed in the end surface of the first fixation block to fix, as a combined unitary structure, the central axle, the left flywheel, the first fixation block, and the left arm crank together to form the left arm exercising device; and wherein the right arm exercising device comprises a right flywheel that is fit and mounted, in a spaced manner, via a plurality of bearings, to the central axle and a second fixation block that is also fit and mounted, in a spaced manner, via a plurality of bearings, to the central axle, wherein the right flywheel has an end surface in which a first keyway is formed, and the second fixation block has an end surface in which a second keyway is formed and corresponding thereto and a key is received in the first and second keyways so as to couple the right flywheel and the second fixation block to each other, the central axle having a right portion that is provided with a second external thread to receive a second nut to screw thereto for positioning and constraining the second fixation block, the second fixation block having an opposite end surface in which a plurality of threaded holes is formed; and a right arm crank, wherein the right arm crank receives a plurality of screws extending therethrough to screw to the plurality of threaded holes formed in the end surface of the second fixation block to couple and combine the right arm crank, the second fixation block, and the right flywheel together to form the right arm exercising device.

2. The multifunctional arm cranking exerciser as claimed in claim 1, wherein the quick release pin device comprises a quick release tubular seat, wherein the quick release tubular seat comprises, arranged therein, a stop plate; a pin that receives a spring fit thereto and is set to extend through the stop plate such that an end of the spring abuts the pin and an opposite end abuts the stop plate; an outer sleeve that comprises a through hole and an internal thread formed therein, wherein the through hole receives a front end of a fixing threaded fastener to extend therethrough to screw to an internal thread of the pin; an inner sleeve that is provided with internal and external threads, wherein the external thread is screwed to the internal thread of the outer sleeve and the internal thread receives an external thread of a connection rod to screw thereto and the connection rod comprises a pin hole formed therein at a location close to a top end; an eccentric rotary knob that comprises a pin hole formed therein and aligning with the pin hole of the connection rod to receive a pivot pin therethrough, wherein the eccentric rotary knob abuts against a top curved surface of the quick release tubular seat and the quick release tubular seat is provided with an external thread on a lower end thereof; a ring, which together with the second fixation block, is provided with an internally threaded hole to screw to the external thread of the quick release tubular seat, wherein the second fixation block is provided with an aperture inwardly of the internally threaded hole; the aperture receives the pin to extend therethrough; the central axle is set at a location in alignment with the pin and is provided with a 0-degree insertion hole and a 180-degree insertion hole at locations respectively corresponding to the left arm crank being set at the same angular position or at an angular position with an angular offset of 180 degrees; the eccentric rotary knob is operable for releasing a holding or pulling force and the spring biases and pushes the pin into and thus being retained in the 0-degree insertion hole to allow the left and right arm exercising devices to move synchronously, or alternatively, the spring biases and pushes the pin into and thus being retained in the 180-degree insertion hole to allow the left and right arm exercising devices to collaboratively move; and the eccentric rotary knob is alternatively operable, through rotation thereof, to induce a pulling force, in an upward direction, for lifting the pin and compressing the spring so as to allow the left and right arm exercising devices to move independently, allowing for exercise with a single hand or independent exercises for two hands.

3. The multifunctional arm cranking exerciser as claimed in claim 1, wherein the damping adjustment device comprises a curved plate, wherein the curved plate is provided, on two opposite sides, which respectively face the left and right flywheels, and a circumferential surface thereof, with a plurality of brake plates and the curved plate is provided, on two opposite sides of a middle thereof, with guide bars, wherein the guide bars support upward the curved plate with elastic members arranged on inner side of the curved plate; a rotary pressure knob, wherein the rotary pressure knob is set, via an elastic element, on the curved plate in an abutting engagement therewith and the rotary pressure knob is screwed, through an external thread, to an internal thread formed on the top of the five-way bracket so that rotating and tightening the rotary pressure knob makes the elastic element applies a pressing force to the curved plate whereby the brake plates induce the damping or resisting force to the left and right flywheels.

4. The multifunctional arm cranking exerciser as claimed in claim 1, wherein the omnidirectional support bracket assembly comprises two tubular bodies extending downward from the five-way bracket and the two tubular bodies are respectively provided, on lower ends thereof, with a first curved tube and a second curved tube rotatably mounted thereto such that the first and second curved tubes are rotatable, for 360 degrees, to reach predetermined positions, respectively, wherein the first curved tube comprises a first swivel terminal rotatably mounted to a lower end thereof and the first swivel terminal comprises a first swing member rotatably mounted to a lower end thereof so that the first swivel terminal is allowed to rotate through a range of 360 degrees for reaching a predetermined angular position, and the first swing member is allowed to swing or rotate in a front-rear direction for a range of 340 degrees; and the second curved tube comprises a second swivel terminal rotatably mounted to a lower end thereof and the second swivel terminal comprises a second swing member rotatably mounted to a lower end thereof, so that the second swivel terminal is allowed to rotate through a range of 360 degrees for reaching a predetermined angular position, and the second swing member is allowed to swing or rotate in a front-rear direction for a range of 340 degrees, wherein the first and second swing members are attachable to a separate or existing leg exerciser.

5. The multifunctional arm cranking exerciser as claimed in claim 1, wherein the multifunctional arm cranking exerciser further comprises an enclosure, wherein the enclosure is mounted to an outer circumference of the multifunctional arm cranking exerciser; the left flywheel and the right flywheel are provided with a plurality of sensor elements; and the enclosure is provided with a display screen electrically connected to the sensor elements so that rotational speeds of the left and right flywheel are selectively displayed on the display screen to be viewed by a user.

6. A multifunctional arm cranking exerciser, comprising:

an omnidirectional support bracket assembly, which comprises a top end to which a five-way bracket is fixedly mounted, the omnidirectional support bracket assembly being adapt to allow the multifunctional arm cranking exerciser to be attached to an existing or a separately purchased leg exerciser to form a hand and leg exerciser;

a left arm exercising device, which is mounted to a left side of the five-way bracket;

a right arm exercising device, which is mounted to a right side of the five-way bracket;

a quick release pin device, which is operable for selectively quick coupling and positioning of left and right arm cranks of the left and right arm exercising devices at an angular difference of 0 degrees for synchronous movement or at an angular difference of 180 degrees for linked, collaborative movement or for selectively quick release and decoupling of the left and right arm exercising devices for independent operation; and a damping adjustment device, which is mounted on the five-way bracket and generates and applies damping or a resisting force to the left arm exercising device and the right arm exercising device, and is operable for adjustment of the damping or the resisting force in order to achieve an effect of exercising;

wherein the quick release pin device comprises a quick release tubular seat, wherein the quick release tubular seat comprises, arranged therein, a stop plate; a pin that receives a spring fit thereto and is set to extend through the stop plate such that an end of the spring abuts the pin and an opposite end abuts the stop plate; an outer sleeve that comprises a through hole and an internal thread formed therein, wherein the through hole receives a front end of a fixing threaded fastener to extend therethrough to screw to an internal thread of the pin; an inner sleeve that is provided with internal and external threads, wherein the external thread is screwed to the internal thread of the outer sleeve and the internal thread receives an external thread of a connection rod to screw thereto and the connection rod comprises a pin hole formed therein at a location close to a top end; an eccentric rotary knob that comprises a pin hole formed therein and aligning with the pin hole of the connection rod to receive a pivot pin therethrough, wherein the eccentric rotary knob abuts against a top curved surface of the quick release tubular seat and the quick release tubular seat is provided with an external thread on a lower end thereof; a ring, which together with the second fixation block, is provided with an internally threaded hole to screw to the external thread of the quick release tubular seat, wherein the second fixation block is provided with an aperture inwardly of the internally threaded hole; the aperture receives the pin to extend therethrough; the central axle is set at a location in alignment with the pin and is provided with a 0-degree insertion hole and a 180-degree insertion hole at locations respectively corresponding to the left arm crank being set at the same angular position or at an angular position with an angular offset of 180 degrees; the eccentric rotary knob is operable for releasing a holding or pulling force and the spring biases and pushes the pin into and thus being retained in the 0-degree insertion hole to allow the left and right arm exercising devices to move synchronously, or alternatively, the spring biases and pushes the pin into and thus being retained in the 180-degree insertion hole to allow the left and right arm exercising devices to collaboratively move; and the eccentric rotary knob is alternatively operable, through rotation thereof, to induce a pulling force, in an upward direction, for lifting the pin and compressing the spring so as to allow the left and right arm exercising devices to move independently, allowing for exercise with a single hand or independent exercises for two hands.

7. The multifunctional arm cranking exerciser as claimed in claim 6, wherein the left arm exercising device comprises a central axle rotatably mounted in the five-way bracket and the central axle has a left portion that comprises, formed and arranged thereon, a male spline and a left flywheel, wherein the left flywheel comprises a first female spine extending therein or therethrough to allow the left flywheel to be mounted, via the first female spine, to the male spline of the central axle; a first fixation block, wherein the first fixation block comprises a second female spine extending therein or therethrough to allow the first fixation block to be mounted, via the second female spine, to the male spline of the central axle and wherein the left portion of the central axle is provided with a first external thread to receive a first nut to screw thereto for fixation to the first fixation block and the left flywheel, and the first fixation block is provided, in an end surface thereof, with a plurality of threaded holes; and a left arm crank, wherein the left arm crank receives a plurality of screws extending therethrough to screw to the plurality of threaded holes formed in the end surface of the first fixation block to fix, as a combined unitary structure, the central axle, the left flywheel, the first fixation block, and the left arm crank together to form the left arm exercising device.

8. The multifunctional arm cranking exerciser as claimed in claim 7, wherein the right arm exercising device comprises a right flywheel that is fit and mounted, in a spaced manner, via a plurality of bearings, to the central axle and a second fixation block that is also fit and mounted, in a spaced manner, via a plurality of bearings, to the central axle, wherein the right flywheel has an end surface in which a first keyway is formed, and the second fixation block has an end surface in which a second keyway is formed and corresponding thereto and a key is received in the first and second keyways so as to couple the right flywheel and the second fixation block to each other, the central axle having a right portion that is provided with a second external thread to receive a second nut to screw thereto for positioning and constraining the second fixation block, the second fixation block having an opposite end surface in which a plurality of threaded holes is formed; and a right arm crank, wherein the right arm crank receives a plurality of screws extending therethrough to screw to the plurality of threaded holes formed in the end surface of the second fixation block to couple and combine the right arm crank, the second fixation block, and the right flywheel together to form the right arm exercising device.

9. The multifunctional arm cranking exerciser as claimed in claim 8, wherein the damping adjustment device comprises a curved plate, wherein the curved plate is provided, on two opposite sides, which respectively face the left and right flywheels, and a circumferential surface thereof, with a plurality of brake plates and the curved plate is provided, on two opposite sides of a middle thereof, with guide bars, wherein the guide bars support upward the curved plate with elastic members arranged on inner side of the curved plate; a rotary pressure knob, wherein the rotary pressure knob is set, via an elastic element, on the curved plate in an abutting engagement therewith and the rotary pressure knob is screwed, through an external thread, to an internal thread formed on the top of the five-way bracket so that rotating and tightening the rotary pressure knob makes the elastic element applies a pressing force to the curved plate whereby the brake plates induce the damping or resisting force to the left and right flywheels.

10. The multifunctional arm cranking exerciser as claimed in claim 6, wherein the omnidirectional support bracket assembly comprises two tubular bodies extending downward from the five-way bracket and the two tubular bodies are respectively provided, on lower ends thereof, with a first curved tube and a second curved tube rotatably mounted thereto such that the first and second curved tubes are rotatable, for 360 degrees, to reach predetermined positions, respectively, wherein the first curved tube comprises a first swivel terminal rotatably mounted to a lower end thereof and the first swivel terminal comprises a first swing member rotatably mounted to a lower end thereof so that the first swivel terminal is allowed to rotate through a range of 360 degrees for reaching a predetermined angular position, and the first swing member is allowed to swing or rotate in a front-rear direction for a range of 340 degrees; and the second curved tube comprises a second swivel terminal rotatably mounted to a lower end thereof and the second swivel terminal comprises a second swing member rotatably mounted to a lower end thereof, so that the second swivel terminal is allowed to rotate through a range of 360 degrees for reaching a predetermined angular position, and the second swing member is allowed to swing or rotate in a front-rear direction for a range of 340 degrees, wherein the first and second swing members are attachable to a separate or existing leg exerciser.

11. The multifunctional arm cranking exerciser as claimed in claim 8, wherein the multifunctional arm cranking exerciser further comprises an enclosure, wherein the enclosure is mounted to an outer circumference of the multifunctional arm cranking exerciser; the left flywheel and the right flywheel are provided with a plurality of sensor elements; and the enclosure is provided with a display screen electrically connected to the sensor elements so that rotational speeds of the left and right flywheel are selectively displayed on the display screen to be viewed by a user.

12. A multifunctional arm cranking exerciser, comprising:

an omnidirectional support bracket assembly, which comprises a top end to which a five-way bracket is fixedly mounted, the omnidirectional support bracket assembly being adapt to allow the multifunctional arm cranking exerciser to be attached to an existing or a separately purchased leg exerciser to form a hand and leg exerciser;

a left arm exercising device, which is mounted to a left side of the five-way bracket;

a right arm exercising device, which is mounted to a right side of the five-way bracket;

a quick release pin device, which is operable for selectively quick coupling and positioning of left and right arm cranks of the left and right arm exercising devices at an angular difference of 0 degrees for synchronous movement or at an angular difference of 180 degrees for linked, collaborative movement or for selectively quick release and decoupling of the left and right arm exercising devices for independent operation; and a damping adjustment device, which is mounted on the five-way bracket and generates and applies damping or a resisting force to the left arm exercising device and the right arm exercising device, and is operable for adjustment of the damping or the resisting force in order to achieve an effect of exercising;

wherein the omnidirectional support bracket assembly comprises two tubular bodies extending downward from the five-way bracket and the two tubular bodies are respectively provided, on lower ends thereof, with a first curved tube and a second curved tube rotatably mounted thereto such that the first and second curved tubes are rotatable, for 360 degrees, to reach predetermined positions, respectively, wherein the first curved tube comprises a first swivel terminal rotatably mounted to a lower end thereof and the first swivel terminal comprises a first swing member rotatably mounted to a lower end thereof so that the first swivel terminal is allowed to rotate through a range of 360 degrees for a reaching predetermined angular position, and the first swing member is allowed to swing or rotate in a front-rear direction for a range of 340 degrees; and the second curved tube comprises a second swivel terminal rotatably mounted to a lower end thereof and the second swivel terminal comprises a second swing member rotatably mounted to a lower end thereof, so that the second swivel terminal is allowed to rotate through a range of 360 degrees for reaching a predetermined angular position, and the second swing member is allowed to swing or rotate in a front-rear direction for a range of 340 degrees, wherein the first and second swing members are attachable to a separate or existing leg exerciser.

13. The multifunctional arm cranking exerciser as claimed in claim 12, wherein the left arm exercising device comprises a central axle rotatably mounted in the five-way bracket and the central axle has a left portion that comprises, formed and arranged thereon, a male spline and a left flywheel, wherein the left flywheel comprises a first female spine extending therein or therethrough to allow the left flywheel to be mounted, via the first female spine, to the male spline of the central axle; a first fixation block, wherein the first fixation block comprises a second female spine extending therein or therethrough to allow the first fixation block to be mounted, via the second female spine, to the male spline of the central axle and wherein the left portion of the central axle is provided with a first external thread to receive a first nut to screw thereto for fixation to the first fixation block and the left flywheel, and the first fixation block is provided, in an end surface thereof, with a plurality of threaded holes; and a left arm crank, wherein the left arm crank receives a plurality of screws extending therethrough to screw to the plurality of threaded holes formed in the end surface of the first fixation block to fix, as a combined unitary structure, the central axle, the left flywheel, the first fixation block, and the left arm crank together to form the left arm exercising device.

14. The multifunctional arm cranking exerciser as claimed in claim 13, wherein the right arm exercising device comprises a right flywheel that is fit and mounted, in a spaced manner, via a plurality of bearings, to the central axle and a second fixation block that is also fit and mounted, in a spaced manner, via a plurality of bearings, to the central axle, wherein the right flywheel has an end surface in which a first keyway is formed, and the second fixation block has an end surface in which a second keyway is formed and corresponding thereto and a key is received in the first and second keyways so as to couple the right flywheel and the second fixation block to each other, the central axle having a right portion that is provided with a second external thread to receive a second nut to screw thereto for positioning and constraining the second fixation block, the second fixation block having an opposite end surface in which a plurality of threaded holes is formed; and a right arm crank, wherein the right arm crank receives a plurality of screws extending therethrough to screw to the plurality of threaded holes formed in the end surface of the second fixation block to couple and combine the right arm crank, the second fixation block, and the right flywheel together to form the right arm exercising device.

15. The multifunctional arm cranking exerciser as claimed in claim 12, wherein the quick release pin device comprises a quick release tubular seat, wherein the quick release tubular seat comprises, arranged therein, a stop plate; a pin that receives a spring fit thereto and is set to extend through the stop plate such that an end of the spring abuts the pin and an opposite end abuts the stop plate; an outer sleeve that comprises a through hole and an internal thread formed therein, wherein the through hole receives a front end of a fixing threaded fastener to extend therethrough to screw to an internal thread of the pin; an inner sleeve that is provided with internal and external threads, wherein the external thread is screwed to the internal thread of the outer sleeve and the internal thread receives an external thread of a connection rod to screw thereto and the connection rod comprises a pin hole formed therein at a location close to a top end; an eccentric rotary knob that comprises a pin hole formed therein and aligning with the pin hole of the connection rod to receive a pivot pin therethrough, wherein the eccentric rotary knob abuts against a top curved surface of the quick release tubular seat and the quick release tubular seat is provided with an external thread on a lower end thereof; a ring, which together with the second fixation block, is provided with an internally threaded hole to screw to the external thread of the quick release tubular seat, wherein the second fixation block is provided with an aperture inwardly of the internally threaded hole; the aperture receives the pin to extend therethrough; the central axle is set at a location in alignment with the pin and is provided with a 0-degree insertion hole and a 180-degree insertion hole at locations respectively corresponding to the left arm crank being set at the same angular position or at an angular position with an angular offset of 180 degrees; the eccentric rotary knob is operable for releasing a holding or pulling force and the spring biases and pushes the pin into and thus being retained in the 0-degree insertion hole to allow the left and right arm exercising devices to move synchronously, or alternatively, the spring biases and pushes the pin into and thus being retained in the 180-degree insertion hole to allow the left and right arm exercising devices to collaboratively move; and the eccentric rotary knob is alternatively operable, through rotation thereof, to induce a pulling force, in an upward direction, for lifting the pin and compressing the spring so as to allow the left and right arm exercising devices to move independently, allowing for exercise with a single hand or independent exercises for two hands.

16. The multifunctional arm cranking exerciser as claimed in claim 12, wherein the damping adjustment device comprises a curved plate, wherein the curved plate is provided, on two opposite sides, which respectively face the left and right flywheels, and a circumferential surface thereof, with a plurality of brake plates and the curved plate is provided, on two opposite sides of a middle thereof, with guide bars, wherein the guide bars support upward the curved plate with elastic members arranged on inner side of the curved plate; a rotary pressure knob, wherein the rotary pressure knob is set, via an elastic element, on the curved plate in an abutting engagement therewith and the rotary pressure knob is screwed, through an external thread, to an internal thread formed on the top of the five-way bracket so that rotating and tightening the rotary pressure knob makes the elastic element applies a pressing force to the curved plate whereby the brake plates induce the damping or resisting force to the left and right flywheels.

17. The multifunctional arm cranking exerciser as claimed in claim 14, wherein the multifunctional arm cranking exerciser further comprises an enclosure, wherein the enclosure is mounted to an outer circumference of the multifunctional arm cranking exerciser; the left flywheel and the right flywheel are provided with a plurality of sensor elements; and the enclosure is provided with a display screen electrically connected to the sensor elements so that rotational speeds of the left and right flywheel are selectively displayed on the display screen to be viewed by a user.

* * * * *